US005355827A

United States Patent [19]

Barbazash et al.

[11] Patent Number: 5,355,827

[45] Date of Patent: Oct. 18, 1994

[54] CATAMARAN

[75] Inventors: Vladimiz Barbazash; Albert D. Kruglov; Boris E. Rapoport, all of St. Petersburg; Yury M. Ukrainskiy, Moscow, all of Russian Federation

[73] Assignee: DCD, Ltd., Moscow, Russian Federation

[21] Appl. No.: 68,737

[22] Filed: May 28, 1993

[51] Int. Cl.[5] ..... B63B 1/12

[52] U.S. Cl. ..... 114/274; 114/283

[58] Field of Search ..... 114/61, 271, 272, 273, 114/274, 275, 283, 292

[56] References Cited

U.S. PATENT DOCUMENTS

| | | | |
|---|---|---|---|
| 4,203,381 | 5/1980 | Wankel | 114/274 |
| 4,449,472 | 5/1984 | Meyer, Jr. | 114/274 |
| 4,606,291 | 8/1986 | Hoppe | 114/274 |
| 4,665,853 | 5/1987 | Gerden et al. | 114/274 |

FOREIGN PATENT DOCUMENTS

| | | | |
|---|---|---|---|
| 889271 | 9/1953 | Fed. Rep. of Germany | 114/274 |

*Primary Examiner*—Stephen P. Avila

*Attorney, Agent, or Firm*—Lieberman & Nowak

[57] ABSTRACT

Multiple-hull catamaran vessels equipped with hydrofoils have two hulls connected by a deck. Transverse to the hulls below the waterline are three or more hydrofoils, the trim bow and stern hydrofoils, and the relieving middle hydrofoil or a group of hydrofoils. The bow and stern hydrofoils are mounted at a distance not less than 30% and 20% of the hull length to the bow and stern, respectively, from the center of mass. Lift arising on all hydrofoils when sailing at a maximum calculated speed in calm sea reaches 60–70% and in calculated rough seas 20–40% of the catamaran's full weight. The bow foil, middle and stern foils account for 0.05–0.15; 0.15–0.30; 0.10–0.25 shares of the catamaran's full weight, respectively. When sailing in rough sea and during vertical travels of the hulls (vertical rocking), "submergence—emergence" takes place which leads to "increase—decrease" of the lift thereby reducing vertical travel amplitude. When the vessel pitches about its lateral axis, the bow hydrofoil and the stern hydrofoil take turns being near the free surface at the moment the other is considerably submerged. A righting moment arises facilitates a decrease of pitching amplitude.

6 Claims, 1 Drawing Sheet

CATAMARAN

BACKGROUND OF THE INVENTION

The present invention relates to the ship building industry, and to multi-hull vessels equipped with hydrofoils in particular.

Catamaran vessels have good speed characteristics due to optimum hydrodynamic shape of the hull, geometrical dimensions relationship, and most importantly, the length of the hull $$\lambda = \frac{L}{B},$$

where L=length between perpendiculars, B=beam athwart ship of a hull on constructive waterline (CWL).

Maximum speed of these vessels in still water corresponds to relative speed $$F2\Delta = \frac{V}{\sqrt{g^3\sqrt{v}}} \geqq 2.5$$

where V=speed, knots; V=volume displacement.

Relative length of high speed catamaran vessels is $\lambda > 10$–12. Hulls are separate with a distance between them not less than the beam of the hull, which makes it possible to avoid negative interference of hulls' wave systems.

However, such vessels have low seaworthiness in rough seas due to considerable amplitudes of pitching and vertical rocking, causing shock overloads.

Increase in seaworthiness is possible by using constructive peculiarities of catamarans, placing between their hulls hydrofoil-stabilizers, the most simple and effective ones of which are shallow-submergence hydrofoils.

The application of low hydrofoils (patented in U.K. in 1968) is known and also of system comprising bow and stern hydrofoils used for stabilization of two-hull catamaran pitching (A. N. Kholodilin, A. N. Shmyreva. Vessels Seaworthiness and Stabilization in Rough Sea. Moscow, Sudostroenie, 1976, pp. 305–306).

In all cases mentioned, the use of a bow hydrofoil and a system of two bow and stern hydrofoils leads to low stabilizing effect in comparison, and barely increases the seaworthiness of a vessel.

A known catamaran has two hulls which are symmetric or asymmetric along their own longitudinal plane, and connect to each other by a deck. Mounted between the hulls are hydrofoils, one of which is the main relieving hydrofoil located near the center of mass, and the other two are trim hydrofoils located astern. The summary lift of hydrofoils is applied to the point near the catamaran center of mass, and the main relieving hydrofoil projection area is 3–5 fold more than the summary projection area of all trim hydrofoils (A. N. Kholodilin, A. N. Shmyreva. Vessels Seaworthiness and Stabilization in Rough Sea. Moscow, Sudostroenie, 1976, pp. 305–306).

A drawback of this catamaran is that when sailing in the basic mode, lift reaches a maximum value and the hulls' stabilizing properties lead to on-course unstable sailing of the catamaran. Because of the slight decrease in rolling, pitching and vertical rocking considerable shock overloads arise, especially in very rough sea conditions.

One known catamaran has two hulls which are symmetric or asymmetric along their own longitudinal plane and connected to each other by a deck, and mounted between the hulls three and more hydrofoils fastened transverse to the hulls below the waterline, and two of them are trim hydrofoils located above and astern, and the middle relieving or a group of middle relieving hydrofoils are located between the bow and stern trim hydrofoils, with summary lift arising out all hydrofoils under the sailing at maximum speed in still water at less than full weight.

This system of hydrofoils makes it possible to decrease water resistance sailing and increase the distance between the water level and lower part of the deck, and this to exclude the possibility of water flooding over the deck (U.S. Pat. No. 4,606,291, issued Aug. 19, 1986).

However, this catamaran also has low seaworthiness. As a result, high speed sailing in still water is considerably lower. Insufficient decrease of amplitude of rolling, pitching and vertical rocking leads to shock overloads arising under very rough sea conditions.

The present invention seeks to increase sailing and seaworthiness and decrease shock overloads when sailing in rough sea conditions by lessening the amplitude of rolling, pitching and vertical rocking.

SUMMARY OF THE INVENTION

The subject catamaran comprises two hulls (symmetric or asymmetric along their own longitudinal plane) and connected to each other by a deck. Mounted transverse to the hulls below the waterline are three or more hydrofoils two of which are trim hydrofoils located above and astern; the middle relieving hydrofoil or group of middle relieving hydrofoils are located between the bow and stern trim hydrofoils. Summary lift arises on all hydrofoils when the catamaran is sailing at maximum speed in still water at less than full weight. The bow trim hydrofoil is mounted at distance of not less than 30% of the hull length of the stern from the catamaran center of mass. Summary lift arising on all hydrofoils when the catamaran is sailing at a maximum calculated speed in still water reaches 60–70% and under calculated sea roughness 20–40% of the catamaran full weight. And the bow trim hydrofoil accounts for 0.05–0.15, the middle reliving hydrofoil or a group of middle relieving hydrofoils—0.15–0.30, and the stern trim hydrofoil accounts for 0.10–0.25 shares of the catamaran's full weight.

Summary lift of the middle relieving hydrofoil, or a group of middle relieving hydrofoils, is located to the bow from the center of mass at the distance of 5–20% of the hull length.

According to the present invention, the bow trim hydrofoil is V—shape or trapezoidal in shape with careenity angle of included element not less than 10°.

The bow trim hydrofoil is mounted at a height at which under sailing in still water at a speed close to a maximum speed, the lower point of the hydrofoil is located higher or lower then the horizontal water level by a magnitude which is not more than half of its chord.

The bow trim hydrofoil is made with additional strengthening elements such as spreaders or struts. Additional strengthening elements are contoured with the possibility of additional lift arising on them in water when sailing.

Taking into account that for high-speed, vessels-catamarans hulls with high hydrodynamic are applied, $$K = \frac{D}{R} >$$

where D = vessel displacement, R = water resistance, it is necessary to use a hydrofoil system, the hydrodynamic quality of which would not be less than of the catamaran as a whole. Otherwise, water resistance in calm sea conditions on a catamaran with hydrofoils-stabilizers would be higher than on a catamaran having no hydrofoils.

The hydrodynamic quality of hulls depends on the load value. For every hull shape there exists the optimum load value under which the hydrodynamic quality reaches maximum. Tests in an experimental pool conducted with different of hulls off—loading made it possible to establish the optimum load share which should be carried by hydrofoils. The providing of the optimum degree of off loading is attained by proper selection of dimensions, hydrofoil contour, the distance between hydrofoils and the height of their mounting. With reference to these considerations, it is possible to strive for the catamaran hydrodynamic quality which would be not less with stabilizers than without them.

As a result of testing hulls with different outlines, it was ascertained that almost in all cases the optimum off loading degree under sailing at a maximum calculated speed in still water reaches 60–70% of the vessel full weight, and at service speed which is approximately by 10% lower in comparison with the maximum calculated speed the off loading is 50–55%, and in calculated sea roughness conditions 20–40% of the catamaran full weight.

The mounting of stabilizers allows achievement of a now essential property: the possibility to have constructionally simple controls of the lift which holds up the hulls when sailing at a speed of $F_{2\Delta} > 1.0$.

This may be used to stabilize pitching and vertical rocking, and to decrease shock overloads. And, it should be taken into account that sailing in calculated sea condition is conducted at speeds which are 1.5–2 times less than sailing speeds in still water. The lift arising on hydrofoils is proportionate to the square of velocity, i.e., decreased by 2–4 times. It is possible to achieve effective stabilization of pitching and vertical rocking parameters, overload decrease under getting a relatively high sailing velocity in rough sea by rational placement of hydrofoils, strict determination of functional purpose of every hydrofoil and usage of constructive peculiarities of high-speed catamarans.

Hydrofoils are divided into two groups: trim and relieving. The present invention provides one relieving hydrofoil or a group and two trim hydrofoils—bow and stern, and the load distribution between hydrofoils tested in experimental pool is specified.

The mounting of two trim hydrofoils makes it possible to build a constant stabilizing moment despite the angular direction of pitching in longitudinal plane: when the stern moves, under water lift is increased on the stern hydrofoil and decreased (or completely disappears) on the bow hydrofoil. In case bow goes underwater, the contrary holds true. Naturally, the placement of trim hydrofoils at the possibly greatest distance leads to increase in arm of the righting moment, the righting moment optimum value is achieved by controlling the hydrofoil load and arranging hydrofoils lengthwise.

The bow trim hydrofoil works, as a rule, in the hard condition because sailing vessels have trim which favors the sailing performance enhancement. A hydrofoil in still water either completely goes out of the water or in certain parts are slightly submerged, and while sailing in rough sea it is periodically bared. Submergence is accompanied by shock loads. That is why it is expedient to slightly load the bow trim hydrofoil in order to solve the problem of strength.

Tests in an experimental pool showed that a new trim hydrofoil should carry load of 5–15% of the hull full weight and should be located at the distance of not less than 30% of the hull length to the bow from the vessel center of mass (CM), and the stern hydrofoil 10–15% of the vessel full weight and be located a distance of not less than 20% of the hull length to the stern from the CM.

The stern hydrofoil which is located in relative optimum working conditions (constantly submerges, located between the hulls) when sailing in calm sea also carries out functions of off-loading facilitating the lessening of the resistance.

It is expedient to load most of the middle hydrofoil (or a group of hydrofoils) to relieve vessel load when sailing in calm seas and to decrease the amplitude of vertical rocking when sailing in rough seas. The test results that the optimum load applied to the middle hydrofoil is 15–30% of the hull full weight. A gain in load complicates the solution of the efficiency of this hydrofoil.

Lengthwise, hydrofoil mounting apart from concern for to the interaction with the bow and stern trim hydrofoils is determined by the following circumstances.

Hydrofoil mounting in the CM makes it possible to almost exclude its influence for the trim and pitching parameters to concentrate its work carrying out its basic functions: relieving and vertical rocking stabilization; on the other hand while sailing in rough seas when a vessel has to face casual waver exceed the calculated ones the bow trim hydrofoil efficiency may turn out to be insufficient, considerable careening and submergence of the vessel bow are possible. It is expedient to shift the middle hydrofoil at a small distance so that its lift would be applied in the point of 5–20% of the hull length to the bow from the CM in order to build a constant moment trimming the vessel by the stern and to provide for the additional safeguard against bow submergence when sailing in rough seas. The middle hydrofoil can be substituted by a group of hydrofoils located lengthwise (tandem) or for height (bode-stand) , but if the following condition is fulfilled: lift resultant of all hydrofoils of the middle group should be located at the point which middle is at 5–20% of the hull length distance to the bow from the CM.

If the middle hydrofoil (or a group of hydrofoils may be made comparatively by construction, they could be flat or with small (up to 10) careenity, the hydrofoil service condition requires special constructive elements providing for its operating reliability when sailing in rough seas.

V-shaped hydrofoil is considered to be optimum with careenity angle of inclined elements not less than 10°, and also can be trapezium shaped with small in extent horizontal sections (2 chords) and inclined elements with careenity angle not less than 10°.

For height, the bow hydrofoil is located so that its lower point is out of water, or is submerged when sailing in still water at a speed close to a maximum one at a distance of not more than chord's half. The bow hydrofoil construction comprises such elements as spreaders or struts which facilitate the hydrofoil strength. The spreaders and struts can be made contoured providing additional lift when entering water.

DETAILED DESCRIPTION OF THE INVENTION

The subject invention will now be described in terms of its preferred embodiments. These embodiments are set forth to aid in the understanding of the invention, but are not to be construed as limiting.

Figure 1:
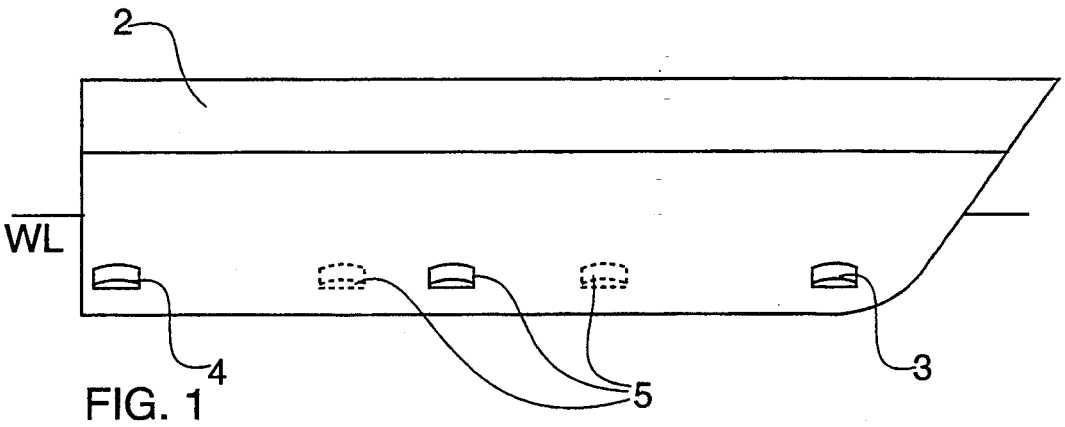
FIG. 1—A longitudinal section of the DP line of a catamaran with symmetrical hulls.
Figure 2:
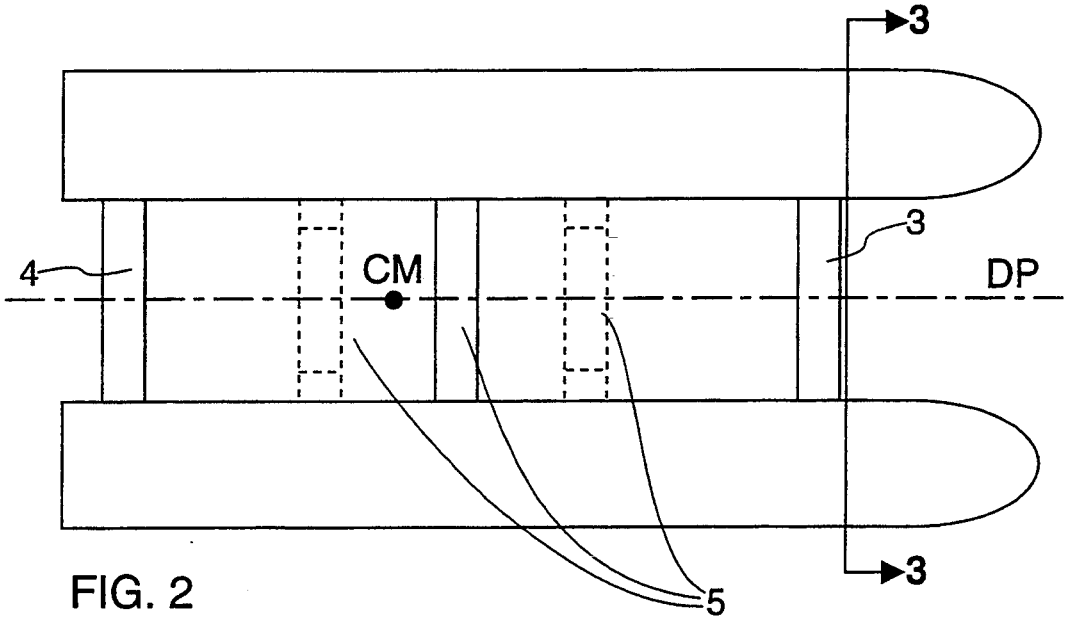
FIG. 2—A WL section of the catamaran.
Figure 3:
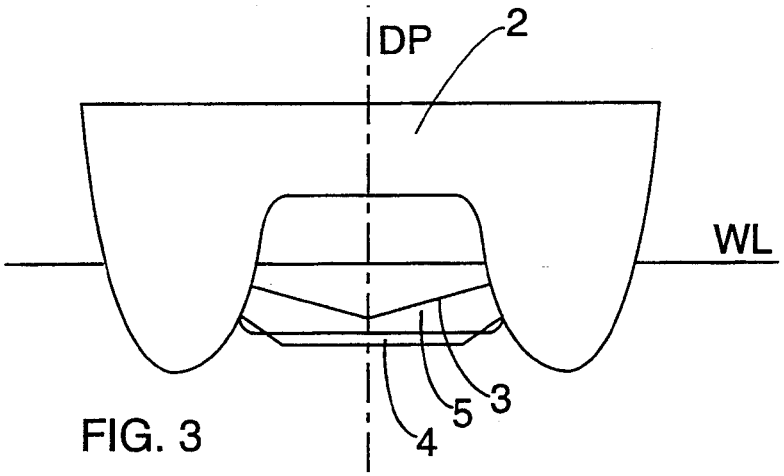
FIG. 3—A cross section taken along line 3—3.

The operating principle of the stabilizing device is showed by an example of catamaran vessel illustrated by drawings where FIG. 1 shows longitudinal section by DP line of the catamaran with symmetric hulls. FIG. 2 illustrates WL section. FIG. 3 illustrates 3—3 cross-section.

The catamaran consists of two hulls (1) which are made symmetric or asymmetric along their own longitudinal plane and connected to each other by deck (2). Transverse to hulls (1) below the waterline (WL) there are three or more hydrofoils the two of which are trim hydrofoils and located one bow—hydrofoil (3), and the other astern—hydrofoil (4). The middle hydrofoil (5) or maybe a group of middle hydrofoils (showed by section-lining on FIG. 1) are relieving hydrofoils and are located between the bow and stern hydrofoils. The bow trim hydrofoil (3) is mounted the distance of not less than 30% of the hull length to the bow from the CM of the catamaran, and the stern trim hydrofoil (4) is mounted at the distance of not less than 20% of the hull length to the stern from the CM. All the hydrofoils are made so that summary lift arising on all the hydrofoils when sailing in calm sea at a maximum calculated speed reaches 60–70%, and when sailing in calculated rough sea—20–40% of the full catamaran weight; and bow trim hydrofoil (3) for 0.05–0.15 full weight glares, the middle relieving hydrofoil (5) or a group of middle relieving hydrofoils—0.15–0.30 full weight shares, and the stern trim hydrofoil (4) accounts for 0.10–0.25 full weight shares.

The middle relieving hydrofoil (5), or a group of middle relieving hydrofoils, are located so that summary lift arising on them is applied to the bow from the CM at the distance of 5–20% of the hull length. This will give rise to additional trim moment which facilitates the pitching decrease in rough sea. The bow trim hydrofoil (3) optimum shape is V—shape or trapezoid shape with careenity angle the inclined elements not less than 10%. The bow trim hydrofoil (3) is mounted at such height that when sailing in rough sea at a speed close to a maximum one the lower point of foil 3 would be located above or lower than the horizontal water surface by the value of not more than the half of its chord. Since the bow hydrofoil (3) is subjected to considerable shock loads, especially when sailing in rough sea, it is constructed with additional strengthening elements (not showed on drawings) such as spreaders and struts are made with a certain contour in order to acquire additional lift when going under water.

When sailing in calm seas in the maximum speed mode, the additional resistance created by hydrofoils is compensated by the lift arising in foils—stabilizers, and flooded surface of the hulls is also reduced. This also takes place while sailing in rough sea at a decreased speed when additional resistance is compensated on account of a decrease in amplitude of pitching and vertical rocking and, as consequence, hull resistance is reduced when sailing in rough seas.

Under vertical travels of the hulls (vertical rocking) the hydrofoils "submergence—surfacing" takes plane which leads to "increase—decrease" of the lift; and it leads to increase under submergence and to decrease under surfacing reduce thereby the vertical rocking amplitudes.

When the vessel travels about the lateral axis (pitching) the bow hydrofoil (3) and the stern hydrofoil (4) take turns in finding themselves near the free surface at the moment when the other one finds itself considerably submerged. The righting moment arises facilitating the decrease of pitching amplitude. The middle hydrofoil (5) relatively close to the CM does not influence the angles of pitching. However, when shifted to the bow from the CM it creates additional trim by the stern which provides for additional safeguard in case the bow hydrofoil at a certain moment in very rough seas (waves exceed the calculated height) is not sufficiently efficient.

Thus, the catamaran of the present construction makes it possible to decrease the amplitudes of rolling, pitching and vertical rocking, while reducing shock overloads and increasing the seaworthy performance of the vessel.

What is claimed is:

1. A catamaran comprising:

(a) two hulls connected to each other by a deck, (b) three or more hydrofoils mounted transverse to said hulls below the water line of the catamaran, at least two of said hulls being trim hydrofoils, and the remaining hydrofoil(s) being relieving hydrofoils, (c) one of said trim hydrofoils being mounted in the bow at a distance of not less than 30% of the hull length to the bow from the center of mass and accounting for from 0.15–0.15 per cent of the total weight of said catamaran, (d) the remaining trim hydrofoil being mounted in the stern at a distance of not less than 20% of the hull length to the stern from the center of mass of the catamaran, and (e) the relieving hydrofoil(s) being positioned intermediate the bow trim hydrofoil and the stern trim hydrofoil and accounting for from 0.10–0.25 per cent of the total weight of the catamaran.

2. A catamaran in accordance with claim 1 wherein the relieving hydrofoil(s) is positioned at a distance from 5–20% of the hull length to the bow from the center of mass of the catamaran.

3. A catamaran in accordance with claim 1 wherein the relieving hydrofoil(s) comprises a group of hydrofoils positioned in tandem.

4. A catamaran in accordance with claim 1 wherein the relieving hydrofoil(s) are positioned in bode-stand.

5. A catamaran of claim 1, wherein the bow trim hydrofoil is V-shape or trapezoidal in shape with a careenity angle of the inclined element being not less than 10°.

6. A catamaran of claim 1, wherein the bow trim hydrofoil is mounted at a weight at which the catamaran when sailing in still water at a speed close to a maximum speed causes the lower portion of the hydrofoil to be located higher or lower portion than the horizontal water level by a magnitude not greater than half of its chord.

* * * * *